US006036108A

United States Patent [19]

Chen

[11] Patent Number: 6,036,108

[45] Date of Patent: Mar. 14, 2000

[54] AUTOMATIC LIQUID SPRAYING DEVICE

[75] Inventor: Cheng-Chang Chen, Taipei Hsien, Taiwan

[73] Assignee: Bobson Hygiene International Inc., Taipei Hsien, Taiwan

[21] Appl. No.: 09/121,668

[22] Filed: Jul. 23, 1998

[51] Int. Cl.[7] ..... B05B 7/32; B65D 83/00

[52] U.S. Cl. ..... 239/274; 239/69; 239/70; 239/99; 239/337; 222/402.13

[58] Field of Search ..... 239/274, 302, 239/337, 67, 69, 70, 99; 222/645–648, 402.13, 402.15

[56] References Cited

U.S. PATENT DOCUMENTS

| | | | |
|---|---|---|---|
| 3,368,717 | 2/1968 | Weber, III | 222/648 |
| 5,242,090 | 9/1993 | Reyss | 222/402.13 X |
| 5,449,117 | 9/1995 | Muderlak et al. | 222/646 X |
| 5,487,502 | 1/1996 | Liao | 222/648 X |
| 5,673,825 | 10/1997 | Chen | 222/646 |
| 5,772,074 | 6/1998 | Dial et al. | 222/646 X |

*Primary Examiner*—Lesley D. Morris
*Assistant Examiner*—Sean P. O'Hanlon
*Attorney, Agent, or Firm*—Sughrue, Mion, Zinn Macpeak & Seas, PLLC

[57] ABSTRACT

An automatic liquid spraying device includes a housing having a wall with a liquid outlet, a liquid container disposed within the housing, and a nozzle member which is installed on an upper end portion of the container and which has a front face formed with a spraying port, and a top surface formed with a groove. A driving unit includes a nozzle activating member, which can press automatically the nozzle member to move toward the container and which has an engagement portion, that engages fittingly the groove in the nozzle member when the nozzle member is pressed by the nozzle activating member to move relative to the container, thereby registering the spraying port in the nozzle member with the liquid outlet in the housing.

9 Claims, 4 Drawing Sheets

AUTOMATIC LIQUID SPRAYING DEVICE

BACKGROUND OF THE INVENTION

1. Field of the Invention

This invention relates to an automatic liquid spraying device, more particularly to an automatic liquid spraying device, which has a nozzle member with self-registering means for registering a spraying port in the nozzle member with a liquid outlet in a housing.

2. Description of the Related Art

The improvement of this invention is directed to a conventional aroma diffuser which can spray automatically an aromatic liquid preparation. The conventional aroma diffuser includes a housing formed with a liquid outlet, a liquid container disposed within the housing and containing an aromatic liquid preparation therein, a nozzle member installed on an upper end portion of the container and having a spraying port, a nozzle activating member, a power supply which can be activated by a sensing unit or a timer, and a gearing, which can be activated by the power supply to drive the nozzle activating member so as to press the nozzle member to move toward the container, thereby spraying the aromatic liquid preparation from the housing through the liquid outlet. However, in use, the spraying port in the nozzle member easily deflects from the liquid outlet in the housing. As a result, the majority of the liquid is sprayed onto an inner surface of the housing.

SUMMARY OF THE INVENTION

The object of this invention is to provide an aroma diffuser with self-registering means which facilitates alignment of a spraying port in a nozzle member with a liquid outlet in a housing.

According to this invention, an automatic liquid spraying device includes a housing having a wall with a liquid outlet, a liquid container disposed within the housing, and a nozzle member which is installed on an upper end portion of the container and which has a front face formed with a spraying port, and a top surface formed with a groove. A driving unit includes a nozzle activating member, which can press automatically the nozzle member to move toward the container and which has an engagement portion, that engages fittingly the groove in the nozzle member when the nozzle member is pressed by the nozzle activating member to move relative to the container, thereby registering the spraying port in the nozzle member with the liquid outlet in the housing.

BRIEF DESCRIPTION OF THE DRAWINGS

Other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
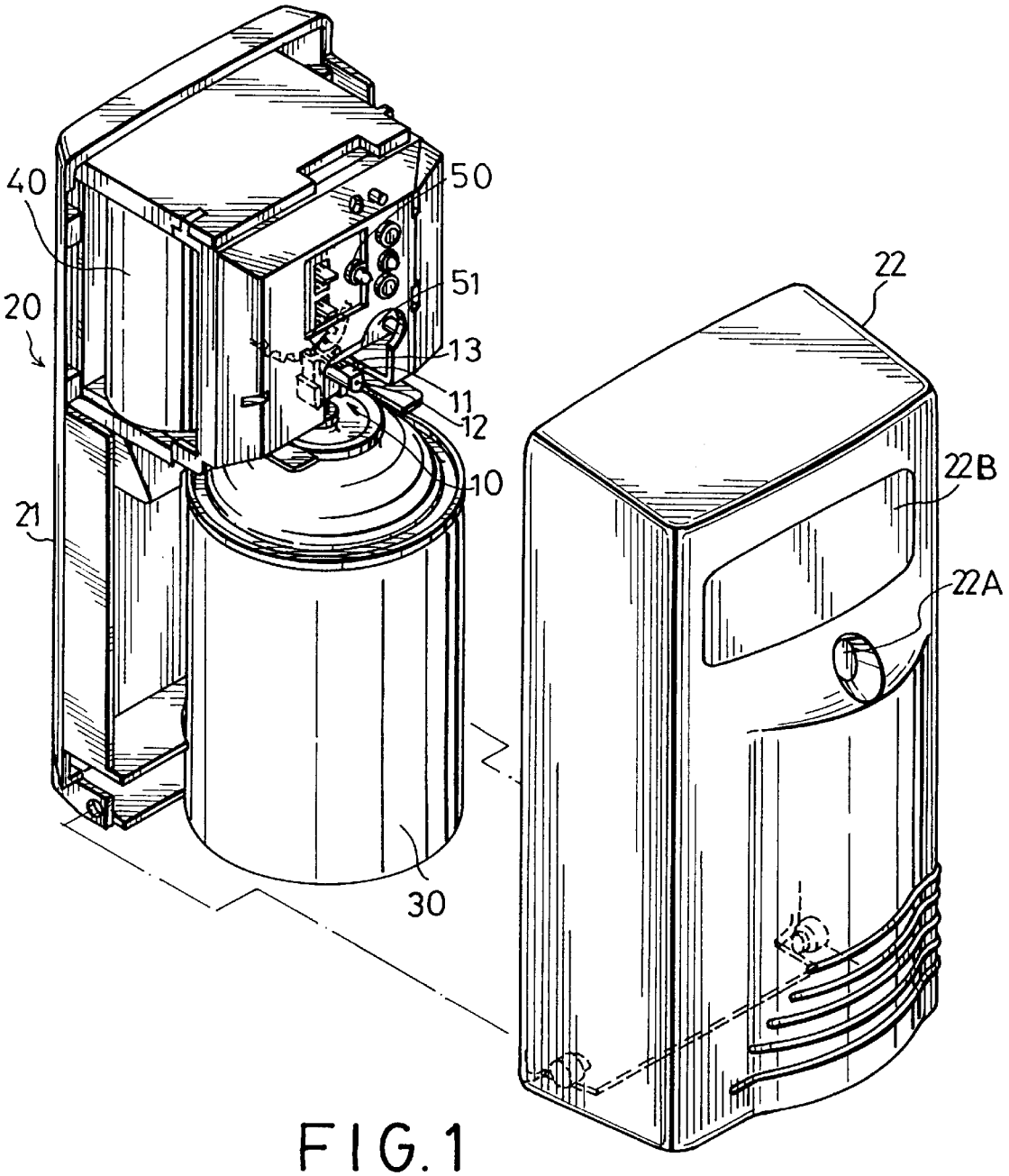
FIG. 1 is an exploded perspective view of a first preferred embodiment of an automatic liquid spraying device according to this invention.
Figure 2:
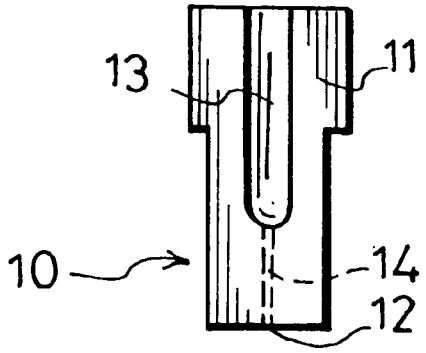
FIG. 2 is a top elevational view of a nozzle member of the first preferred embodiment.
Figure 3:
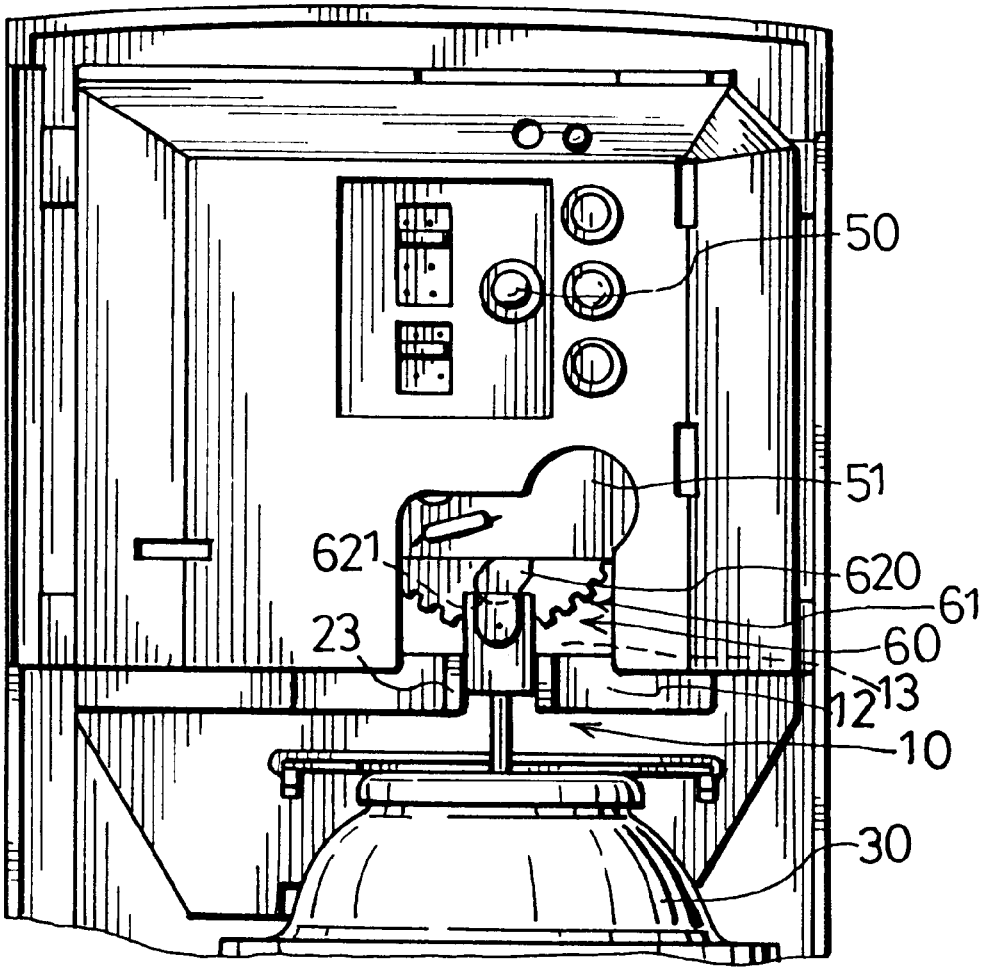
FIG. 3 is an elevational view of an upper portion of the first preferred embodiment, in which a front cover is removed for the sake of clarity.

Referring to FIGS. 1 to 3, a first preferred embodiment of an automatic liquid spraying device according to this invention is shown to be in the form of an aroma diffuser. The diffuser includes a spring-biased nozzle member 10, which is disposed in a housing 20 and which is installed on an upper end portion of a liquid container 30, in a known manner.

The nozzle member 10 has an elongated top surface 11, a front face with a spraying port 12, an elongated straight groove 13, and a straight liquid passage 14. The groove 13 extends lengthwise along the top surface 11, and has a closed front end at an intermediate portion of the top surface 11, and an open rear end.

The housing 20 includes a back plate 21 and a front cover 22, which is mounted detachably on the back plate 21 in a known manner and which is formed with a liquid outlet 22A and an opening 22B. A pair of opposed ribs 23 are formed on the housing 20 in a known manner to define therebetween a slide slot 24 (see FIG. 4) in which the nozzle member 10 can slide. A power supply or battery unit 40 is mounted in the housing 20 over the liquid container 30. A sensing unit 50 is installed in the housing 20, and is aligned with the opening 22B in the front cover 22. When the sensing unit 50 detects the presence of a person in front of the aroma diffuser, an electrical signal is sent to a control circuit unit 51. The power supply 40 is enabled to activate a driving unit 60 for a preset period at this time.

The driving unit 60 includes a reduction gearing 61 and a nozzle activating member 62. The nozzle activating member 62 is a sector gear, which has an integral engagement portion 620 formed with a rounded lower edge 621, that abuts against an upper end of the nozzle member 10. The driving unit 60 can rotate the nozzle activating member 62 counterclockwise to move the engagement portion 620 from the position of FIG. 4 to that of FIG. 5 in a known manner. As such, the nozzle member 10 is pressed to move toward the container 30 by the nozzle activating member 620, thereby spraying the aromatic liquid preparation from the container 30. Because the engagement portion 620 of the nozzle activating member 62 engages fittingly the groove 13 in the nozzle member 10 during the movement of the nozzle member 10 relative to the container 30, the spraying port 12 and the liquid passage 14 are aligned with the liquid outlet 22A in the front cover 22. Accordingly, the liquid can be sprayed fully from the housing 20.

Figure 5:
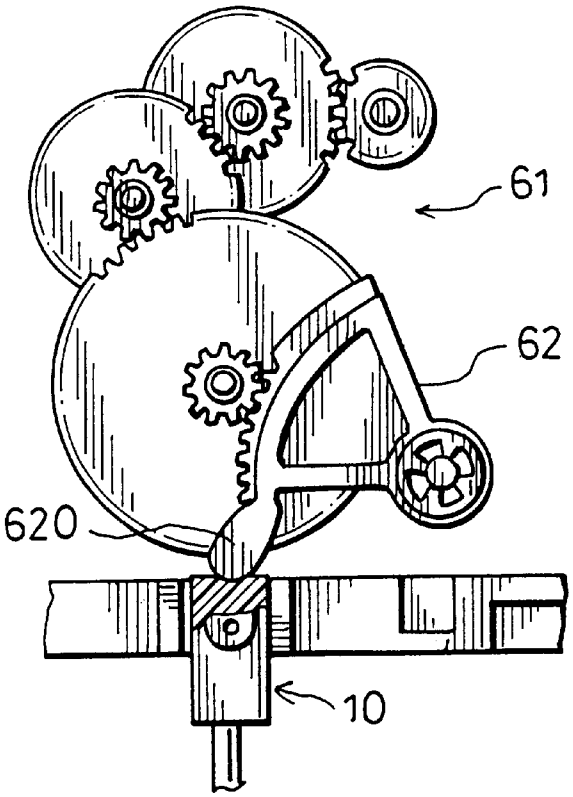
FIG. 5 illustrates the lower limit position of the nozzle member of the first preferred embodiment.
Figure 4:
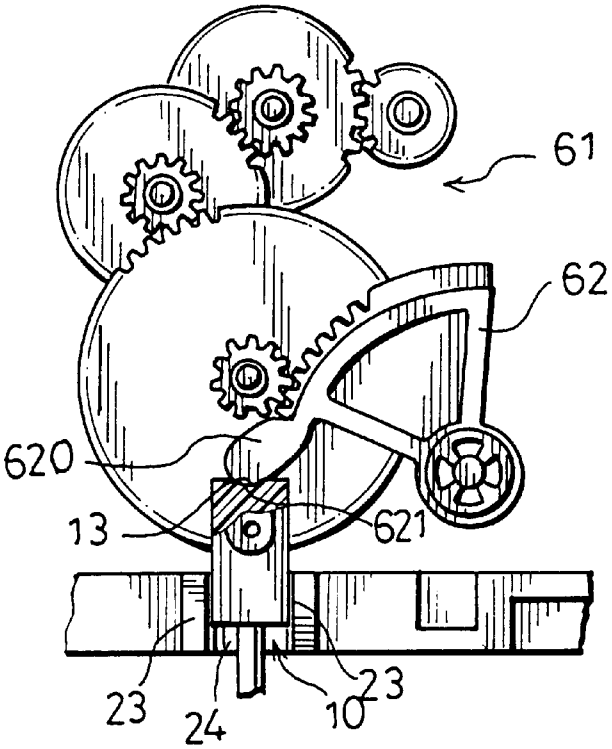
FIG. 4 illustrates the upper limit position of the nozzle member of the first preferred embodiment.

After the nozzle member 10 moves from the upper limit position of FIG. 4 to the lower limit position of FIG. 5 and sprays the liquid for a preset period, it is returned to the position of FIG. 4 by means of a spring (not shown) in a known manner so as to rotate the nozzle activating member 62 clockwise to the position of FIG. 4. In this manner, the nozzle activating member 62 can swing automatically between the positions of FIGS. 4 and 5.

Figure 6:
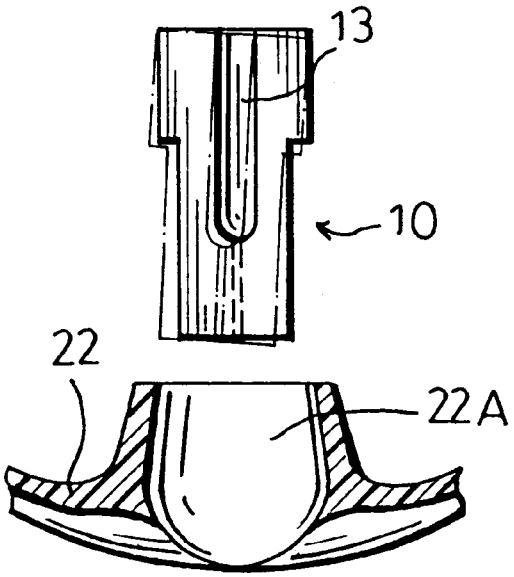
FIG. 6 illustrates the self-registering action of the nozzle member of the first preferred embodiment.

Referring to FIG. 6, even if the nozzle member 10 is placed at a position shown in broken lines, where the spraying port 12 (see FIG. 2) in the nozzle member 10 somewhat deflects from the liquid outlet 22A in the front cover 22, when the rounded lower edge 621 of the engagement portion 620 of the nozzle activating member 62 turns downward to press the nozzle member 10, the nozzle member 10 rotates about the container 30 (see FIG. 1) by a small angle to the position shown in solid lines, where the spraying port 12 (see FIG. 2) is registered with the liquid outlet 22A in the front cover 22.

Figure 7:
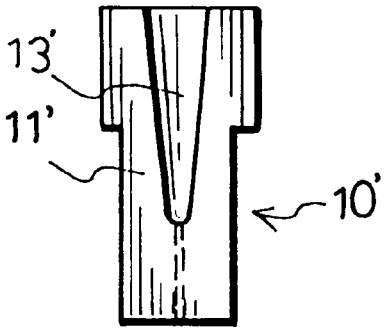
FIG. 7 is a top elevational view of a nozzle member of a second preferred embodiment of an automatic liquid spraying device according to this invention.

Referring to FIG. 7, a second preferred embodiment of this invention is shown to have a modified nozzle member 10'. Unlike the previous embodiment, the nozzle member 10' has a tapered groove 13', which extends lengthwise along a top surface 11' of the nozzle member 10' and which has a closed front end at an intermediate portion of the top surface 11', and an open rear end that is wider than the front end of the groove 13'.

With this invention thus explained, it is apparent that numerous modifications and variations can be made without departing from the scope and spirit of this invention. It is therefore intended that this invention be limited only as indicated in the appended claims.

I claim:

1. An automatic liquid-spraying device, comprising:

a housing having a wall formed with a liquid outlet;

a liquid container disposed within said housing;

a nozzle member installed on an upper end portion of said container in such a manner that said nozzle member can move vertically relative to said container, said nozzle member having a front face formed with a spraying port, and a top surface formed with a groove; and a driving unit including a nozzle activating member, which can press automatically said nozzle member to move toward said container and which has an engagement portion with a rounded lower edge, that engages fittingly with said groove when said nozzle member is pressed by said nozzle activating member to move relative to said container, whereby said movement of said nozzle member causes registration of said spraying port in said nozzle member with said liquid outlet in said housing and corrects misregistration of said spraying port with said liquid outlet.

2. A device as claimed in claim 1, wherein said top surface of said nozzle member is elongated, said groove being a straight groove, which extends lengthwise along said top surface of said nozzle member and which has a closed front end at an intermediate portion of said top surface, and an open rear end.

3. A device as claimed in claim 1, wherein said top surface of said nozzle member is elongated, said groove being a tapered groove, which extends lengthwise along said top surface of said nozzle member and which has a closed front end at an intermediate portion of said top surface, and an open rear end that is wider than said front end of said groove.

4. A device as claimed in claim 1, wherein said engagement portion is movable downward relative to said container and a lower edge of said engagement portion is rounded, thereby gradually making contact with said groove as the nozzle activating member turns downward.

5. A device as claimed in claim 1, wherein said engagement portion causes said nozzle member to rotate about said container, thereby registering said spraying port with said liquid outlet.

6. A device as claimed in claim 1, further comprising a sensing unit installed in said housing which detects a presence of a person in front of said automatic liquid spraying device and upon detecting the presence of a person causes said driving unit to operate and said engagement portion of said nozzle activating member to fittingly engage said groove of said nozzle member.

7. An automatic liquid-spraying device, comprising:

a housing having a wall formed with a liquid outlet;

a liquid container disposed within said housing;

a nozzle member installed on an upper end portion of said container in such a manner that said nozzle member can move vertically relative to said container, said nozzle member having a front face formed with a spraying port, and a top surface formed with a groove; and a driving unit including a nozzle activating member, which can press automatically said nozzle member to move toward said container and which has an engagement portion, that engages fittingly with said groove only when said nozzle member is pressed by said nozzle activating member to move relative to said container, whereby said movement of said nozzle member causes registration of said spraying port in said nozzle member with said liquid outlet in said housing.

8. An apparatus, comprising:

a housing for accommodating a liquid container, said housing having a liquid outlet formed therein, said liquid container having a nozzle member for automatically spraying liquid through said liquid outlet; and means for automatically pressing said nozzle member to move toward said liquid container while said means engages fittingly a groove on a top surface of said nozzle member, thereby to register a spraying port in said nozzle member with said liquid outlet and correct misregistration of said spraying port with said liquid outlet.

9. An apparatus for accommodating a liquid container, the liquid container having a nozzle member for automatically spraying liquid, the apparatus comprising:

a housing for accommodating the liquid container, said housing having a liquid outlet formed therein; and a driving unit for automatically pressing said nozzle member to move toward said liquid container while said driving unit fittingly engages a groove on a top surface of said nozzle member, thereby to register a spraying port in said nozzle member with said liquid outlet and correct misregistration of said spraying port with said liquid outlet.

* * * * *